US006978954B2

(12) United States Patent
Kroger et al.

(10) Patent No.: US 6,978,954 B2
(45) Date of Patent: Dec. 27, 2005

(54) DETECTOR FOR A SHREDDER

(75) Inventors: Bruce R. Kroger, West Chicago, IL (US); Dmitry N. Romanovich, Glen Ellyn, IL (US); Vadim N. Romanovich, Glen Ellyn, IL (US)

(73) Assignee: Fellowes, Inc., Itasca, IL (US)

( * ) Notice: Subject to any disclaimer, the term of this patent is extended or adjusted under 35 U.S.C. 154(b) by 22 days.

(21) Appl. No.: 09/940,726

(22) Filed: Aug. 28, 2001

(65) Prior Publication Data

US 2003/0042342 A1 Mar. 6, 2003

(51) Int. Cl.[7] ..... B02C 25/00
(52) U.S. Cl. ..... 241/36; 241/100; 241/236; 241/101.3
(58) Field of Search ..... 241/100, 36, 101.3, 241/236

(56) References Cited

U.S. PATENT DOCUMENTS 3,882,770 A * 5/1975 Bleasdale ..... 100/49
4,650,128 A 3/1987 Goldhammer
5,102,057 A * 4/1992 Ellis, III ..... 241/99
5,167,374 A 12/1992 Strohmeyer
5,318,229 A 6/1994 Brown
5,375,781 A 12/1994 Schwelling
5,464,162 A 11/1995 Kusters
5,897,065 A 4/1999 Schwelling
5,934,584 A 8/1999 Schwelling

FOREIGN PATENT DOCUMENTS

DE 10032069 A1 * 2/2002

* cited by examiner

*Primary Examiner*—Mark Rosenbaum
(74) *Attorney, Agent, or Firm*—Pillsbury Winthrop Shaw Pittman, LLP

(57) ABSTRACT

A shredder for shredding material is provided that includes a housing. having a cutting device to shred material. A receptacle is also included and is positioned to receive the shredded material. A detecting device is positioned between the cutting device and the receptacle and emits and detects a beam so that when shredded material occupies a first position within the receptacle the beam is interrupted. Advantageously, the detecting device may be used as a bin full detection device to provide indication that a bin is filled or substantially filled with shredded material.

11 Claims, 3 Drawing Sheets

DETECTOR FOR A SHREDDER

FIELD OF THE INVENTION

The present invention relates to a detector for detecting the level of shredded papers and in particular to a detector for use with a paper shredder or other comminuting device that detects when accumulated shredded material paper reaches a predetermined level.

BACKGROUND

When papers are to be discarded, it is desirable to shred them so that others cannot obtain and read them. This is often accomplished by a paper shredder or comminuting device. Typically, one or more documents are fed into a cutting device such as a pair of cutting cylinders. The document is then cut into strips or particles, which exit the shredder and are typically collected in a receptacle.

One problem with shredders occurs when the receptacle fills to capacity. If the receptacle is not emptied, the shredded material continues to accumulate and ultimately spills into the area surrounding the shredder. Besides being unsightly, such a condition may cause an occupational hazard and may be cumbersome to clean up. Another problem that occurs when the receptacle is not emptied in a timely way is that the shredded material may accumulate within the shredder, causing the cutting device to jam and malfunction.

One way to deal with these problems is described in U.S. Pat. No. 5,897,065. This patent describes a mechanical device such as an activating flap or vane to detect when the receptacle is full. Typically, the device is mounted either within the cutting device housing, or within the vicinity of the receptacle. The receptacle is detected as full when the flap or vane is physically moved out of position by the accumulated paper. These types of mechanical detection devices, however, have several drawbacks. First, the shredded material must develop into a grouping that has a density sufficient to activate the flap or vane. When the mechanical device is mounted within the housing, by the time the shredded material grouping achieves such a density, the shredded material may have compacted inside the cutting device to the extent that the cutting device jams. Rectifying such a jam may be problematic. If the activating device is mounted away from the cutting device and near the receptacle, the activating device may be in the way when the receptacle is removed to be emptied.

Accordingly, it would be desirable to have a device that overcomes the disadvantages and limitations described above. The present invention solves the above problem by providing a detecting device to detect the presence of shredded material.

BRIEF SUMMARY

A shredder for shredding material is provided that includes a housing having a cutting device to shred material. A receptacle is also included and is positioned to receive the shredded material. A detecting device is positioned between the cutting device and the receptacle and emits and detects a beam so that when shredded material occupies a first position within the receptacle the beam is interrupted.

Another aspect of the present invention includes a detection apparatus that detects the presence of shredded material. The apparatus includes a comminuting device having an egress for shredded material and a detecting device that emits and detects an infrared detection beam. The detecting device is positioned after the egress and is electrically connected with the comminuting device. The comminuting device is deactivated when the detection beam is interrupted by shredded material for a predetermined amount of time.

Another aspect of the present invention includes a comminuting device having an area from which comminuted material exits. A detecting device is provided that emits and detects a beam. The detecting device is located adjacent the area from which the comminuted material exits. The comminuting device is rendered inoperable when the beam is interrupted by the comminuted material for a period of time greater than a predetermined period of time.

For purposes of simplicity and convenience, the shredder or comminuting device will be described as a paper shredder. One skilled in the art, however, will readily understand that the use of the term paper does not limit the scope of the present invention.

DETAILED DESCRIPTION OF THE PRESENTLY PREFERRED EMBODIMENTS

Figure 2:
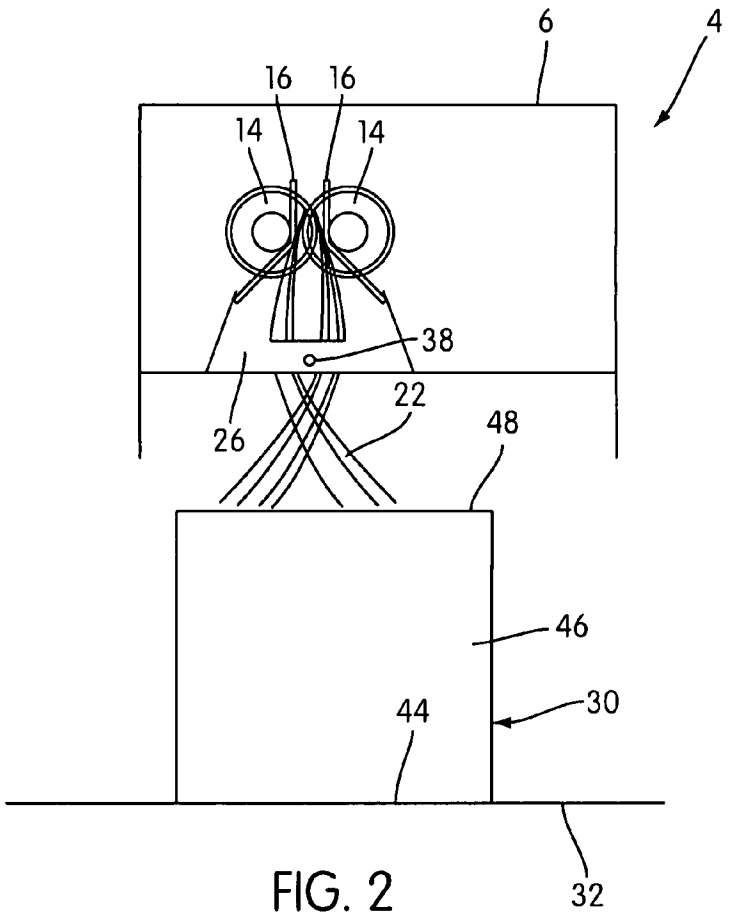
FIG. 2 is a side plan view of the paper shredder of FIG. 1 taken along the line 2—2.
Figure 1:
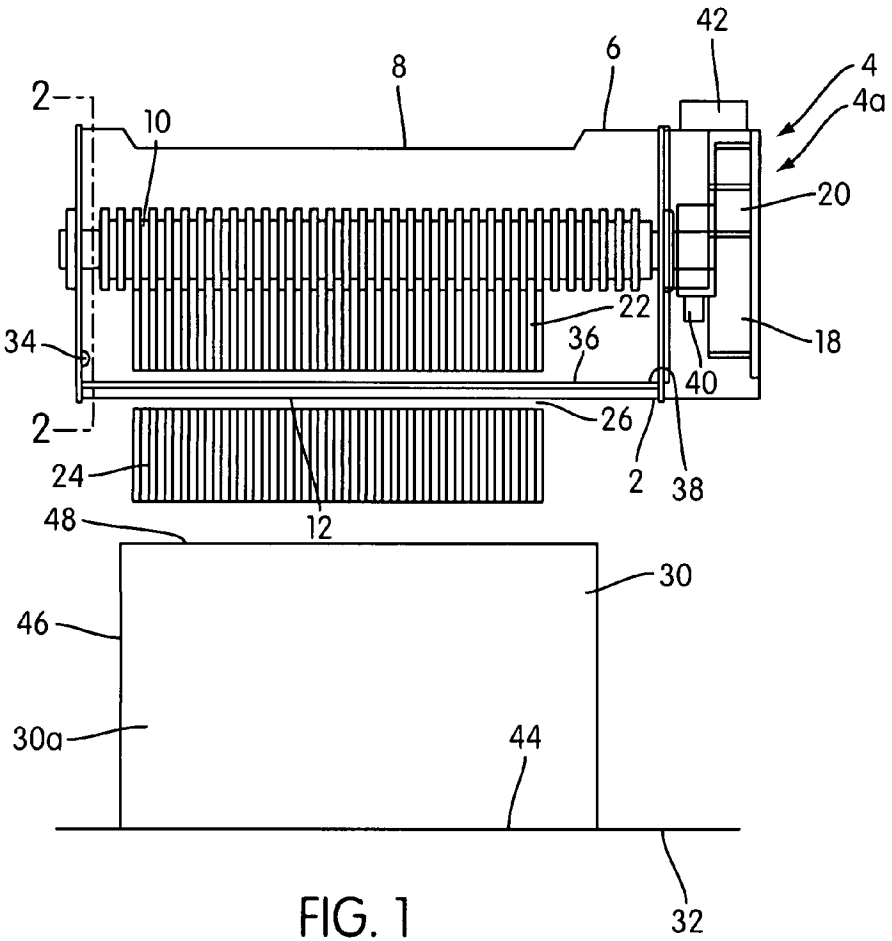
FIG. 1 is a front plan view of a strip cut paper shredder according to one embodiment of the present invention with portions removed to clearly show the inventive features of the present invention.

Turning now to the drawings, FIGS. 1 and 2 show one preferred embodiment of a detecting device 2. When in use, the detecting device 2 is used in conjunction with a comminuting device such as a paper shredder 4. The shredder 4 includes a housing 6 having an input area 8, a cutting device 10, and an output area 12. The input area 8 accepts paper that is to be fed into the shredder 4 for cutting. Upon being received by the input area 8, the paper is shredded by the cutting device 10.

As shown in FIG. 2, the cutting device typically includes a pair of cylinders 14 having blades 16 attached to them. A motor assembly 18 drives the cutting device 10. Power is supplied to the motor assembly via a power switch 20. The blades rip or shred the material being fed to the device and the shredded material then exits the housing via the output area.

The above-described components are well known in the art. Any suitable type of paper shredder may be used. For example, FIG. 1 shows a strip cut style shredder 4*a*. Upon being shredded or cut by the cutting device, strips 22 of paper are expelled from the output area. The strips are expelled intermittently, side-by-side in the form of groups 24 of long strips. Typically, there is a gap 26 between the groups 24 of long strips being expelled from the output area 12 of the housing 6.

Figure 4:
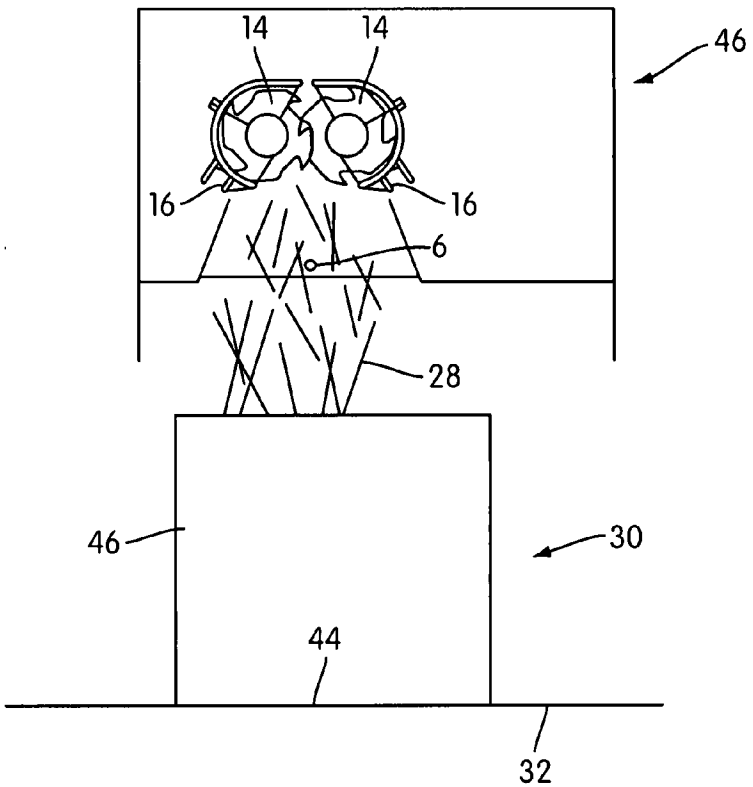
FIG. 4 is a side plan view of the paper shredder of FIG. 3 taken along the line 4—4.
Figure 3:
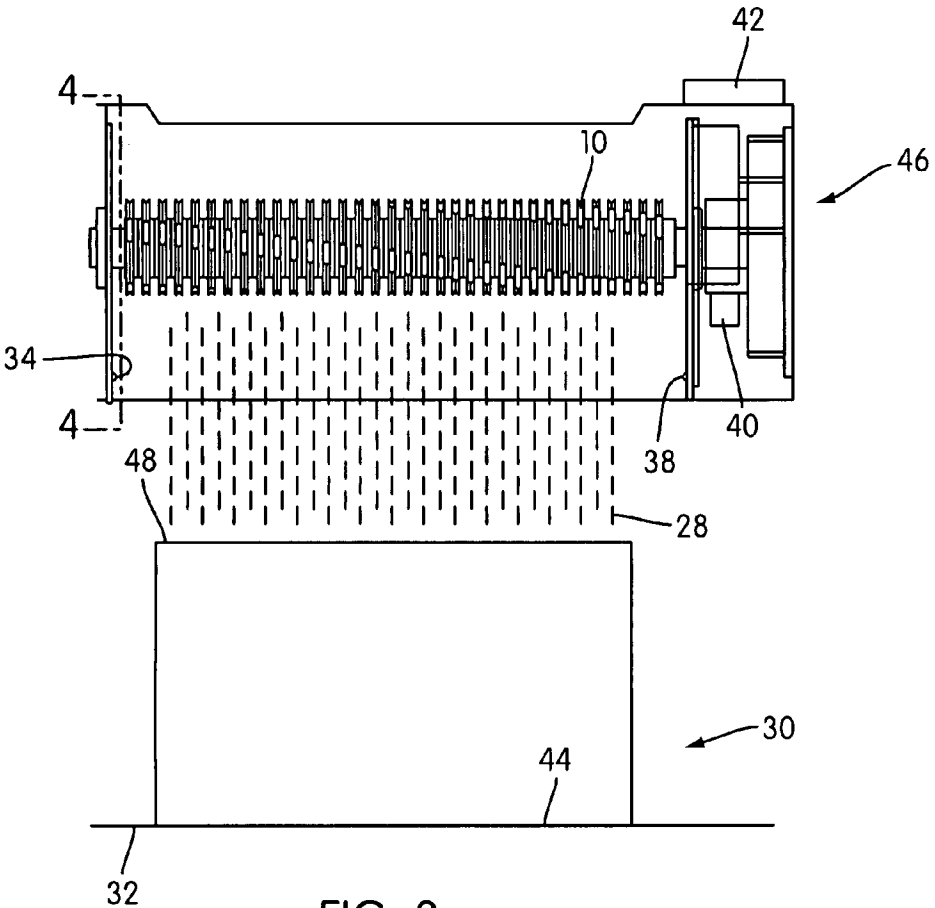
FIG. 3 is a front plan view of a cross-cut paper shredder according to one embodiment of the present invention with portions removed to clearly show the inventive features of the present invention.

FIGS. 3 and 4 show another embodiment of a paper shredder known as a cross-cut shredder 4*b*. The cross-cut shredder is similar to the strip cut shredder, except that due to the configuration of the cutting device 10, cross-cut particles or chips 28 are intermittently expelled from the output area 12 of the cross-cut shredder 4*b*, rather than in groups of strips associated with the strip cut shredder 4*a*.

A receptacle 30 receives the shredded material. The receptacle 30 includes a bottom 44 and at least one wall 46 extending from the bottom. Together the bottom 44 and wall 46 define an open top 48 to receive shredded material. As shown in FIG. 1, in a preferred embodiment the receptacle is simply a bin 30*a* that is placed beneath the housing and rests adjacent a flat surface 32 such as a floor or the base of a shredder cabinet. In other embodiments, the flat surface and receptacle may be oriented so that they are not beneath but still adjacent to the housing. Alternatively, the receptacle may be a bag that is attached with the housing. In other embodiments, the receptacle may be eliminated and shredded materials may be allowed to accumulate on the flat surface.

The detecting device 2 is preferably located adjacent to the cutting device. In other embodiments, however, the detecting device may be otherwise located, for example adjacent to the output area or adjacent to the open top of the receptacle. The detecting device includes a first end 34 that emits a beam 36 and a second end 38 that receives and detects the beam 36. In one embodiment, the detecting device 2 emits an infrared beam. Other beams that may be used as part of the present invention include but are not limited to lasers, high-energy LEDs, or other types of visible light, as well as light that is not in the visible spectrum.

As will be discussed in further detail below, the detecting device detects the presence of accumulated shredded material at a predetermined position. When the beam of the detecting device is interrupted by accumulated shredded material for a preset period of time, power is removed from the paper shredder. The detecting device is oriented in the positions described above so that it may detect the presence of accumulated shredded material at the predetermined position. Generally, the detecting device is located at a position relative to the cutting device to minimize or prevent an accumulation of shredded material that would cause the cutting device to jam. Accordingly, the detecting device can be located at a position from about 0.5 inch to about 10 inches, preferably from about 1 inch to about 5 inches, and more preferably about 3 inches from the cutting mechanism. The detecting device is, of course, located at the egress or exit side of the cutting device.

When, however, a receptacle is provided to receive the shredded material, it may be generally desirable to position the detecting device at a position relative to the open top to provide an indication that the receptacle is filled or substantially filled. Accordingly, the detecting device may be positioned between the open top and the bottom in the range between about 0.5 inch and about 10 inches. Of course, one skilled in the art will understand that the position of the detecting device described above with respect to its position from the cutting device may be suitable for determining whether the receptacle is full or substantially full.

In one embodiment, the paper shredder includes a timer 40 that is electrically connected with the power switch 20 and detecting device 2. The timer 40 is set to a preset period of time in a range between about 1 and 30 seconds, preferably between about 2 and 10 seconds, and more preferably between about 3 and 5 seconds. When the beam 36 of the detecting device is interrupted for the preset period of time, the timer sends a signal that causes the cutting device to stop. In the embodiment where a receptacle is provided, the beam will be interrupted for longer than the preset period of time when the accumulated shredded paper is at a predetermined position relative to the flat surface as described above.

An indicator 42 may also be included with the paper shredder to provide indication that the beam has been interrupted for longer than the preset period of time and as a result the paper shredder has ceased operation. In one embodiment, the indicator 42 will provide visual indication that the receptacle is full, such as through the use of a "Bin Full" light. In other embodiments, however, other types of indication may be provided, such as audible indication through the use of a buzzer.

Figure 5:
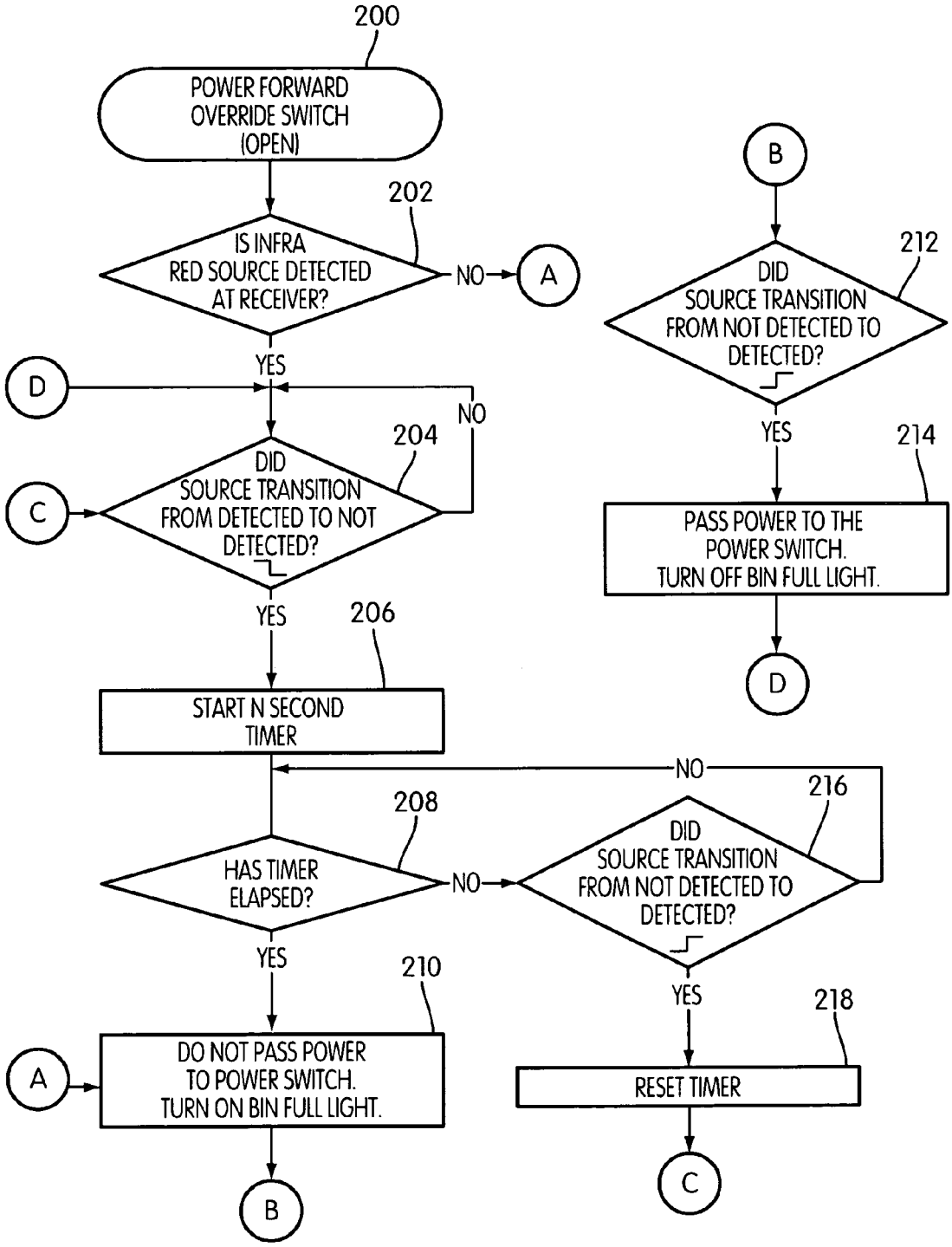
FIG. 5 is a flow diagram showing the operation of one embodiment of a detector according to the present invention.

FIG. 5 is a flow diagram showing the operation of the detecting device. Although the diagram refers to an infrared beam, as noted above, other types of beams may be utilized. At 200, the start of the process, a power override switch is in the open state. The power override switch, which does not form a part of the present invention, allows the shredder retain power regardless of the state of the detecting device when placed in the closed position. If, at the start of the process, the beam is not detected (at 202), power will not be passed to the power switch and the indicator will be activated (at 210), indicating that the presence of accumulated shredded paper has been detected. Power will not pass to the power switch to begin the shredding process until the beam is detected (at 212, 214). Once the beam is detected, the indicator will be deactivated (at 214). If the beam is detected at the start of the process (at 202), however, the shredding process will begin and will continue as long as the beam is detected (at 204).

If during the shredding process the beam is no longer detected (at 204), the timer will begin counting (at 206). As noted above, the timer preferably will be preset in the range of about 1 to 30 seconds. If during the preset time period the beam is once again detected (at 208, 216), the timer will be reset (at 218) and the shredding process will continue.

The beam will be detected for a period less than the preset amount of time due to the intermittent passing of shredded paper out of the output area of the housing. The shredded paper will interrupt the beam for short periods of time as it passes to the receptacle. As noted above, when a strip cut shredder is in use groups of strips of shredded paper may intermittently interrupt the detector beam. The gaps between the groups of strips will cause the detector beam to be detected by the second end, or receiver, of the detecting device before the timer has elapsed. When a cross-cut shredder is used, the paper strips or particles will be expelled randomly from the output area, causing the beam to change between a detected and non-detected state approximately every few milliseconds.

If the timer elapses (at 208), this will indicate the presence of accumulated shredded paper. Power will no longer be passed to the power switch, shutting down the motor assembly and ceasing operation of the paper shredder (at 210). The indictor will also be activated to provide notification of the presence of accumulated shredded paper. As noted above, operation of the paper shredder will not begin until the beam is again detected at the receiver of the detecting device. This will required removing the shredded paper out of the path of the beam. In embodiments that include a receptacle, this is typically accomplished by emptying and replacing the receptacle.

The advantages of the above-described embodiments of the detecting device of the present invention are numerous. The detecting device of the present invention will prevent shredded material from continuing to accumulate in a receptacle that is at capacity. This in turn will prevent the materials from spilling into the area surrounding the shredder. Besides being unsightly, such a condition may cause an occupational hazard and may be cumbersome to clean up. The detecting device will also help ensure that shredded material will not continue accumulating and ultimately accumulate within the paper shredder, causing the shredding device to jam and malfunction.

The detecting device of the present invention will also reduce the occurrence of a problem known as "bird nesting." Bird nesting occurs when particles or strips of material gather by the output area of the housing due to static. When this happens, particles may continue to collect, forming a "bird nest" shape, and may ultimately cause jamming within the housing. With the present invention, when a bird nest begins to form, the beam of the detecting device will be interrupted, causing the shredder to shut down. Hence, a jam will be avoided.

The detecting device of the present invention also has several advantages over mechanical devices that are typically used to detect the level of shredded paper. These mechanical devices include activating flaps or vanes. Usually, these types of devices are mounted either within the housing, or within the vicinity of a receptacle. The receptacle is detected as full when the flap or vane is physically moved out of position by the accumulated paper. In order to move the flap or vane out of position, however, the shredded papers must develop into a grouping that has a density sufficient to activate the flap or vane. With regard to mechanical devices that are placed within the housing, by the time the paper grouping achieves such a density, the paper may have compacted inside the cutting mechanism to the extent that a paper jam is caused. The detecting device presented herein, in contrast, will avoid this type of problem because such a density is not required since a device does not need to be physically moved in order to detect the level of shredded paper.

Moreover, if the mechanical device is mounted away from the cutting mechanism and near the receptacle, the device may be in the way when the receptacle is removed in order to be emptied. With the present invention, there is no physical object in the path or vicinity of the receptacle, allowing for easy removal and replacement.

The embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

What is claimed:

1. A shredder for shredding material, comprising:

a housing having a cutting device to shred material;

a receptacle positioned to receive the shredded material, and enabling the shredded material to accumulate within the receptacle;

a detecting device including a detector that emits and detects a beam, the detector being positioned below the cutting device at a predetermined height with respect to the receptacle such that the beam is interrupted when the shredded material accumulates within the receptacle to a level at or above the predetermined height; and the detecting device being coupled to the cutting device, wherein the detecting device determines if the beam has been interrupted for at least a predetermined period of time and in response prevents operation of the cutting device until the beam is no longer interrupted, and wherein the detecting device ignores interruptions of the beam for less than the predetermined period of time and enables operation of the cutting device to continue.

2. The shredder of claim 1 wherein the detector emits an infrared beam.

3. The shredder of claim 1 wherein the detector further comprises a light emitting diode.

4. The shredder of claim 1 wherein the detector further comprises a laser.

5. The shredder of claim 1 wherein the detector further comprises a light source not in a visible spectrum.

6. The shredder of claim 1, wherein the predetermined period of time is between about 1 to about 30 seconds.

7. The shredder of claim 1 further comprising an indicator to provide indication to a user when the detecting devices determines that the beam has been interrupted for at least the predetermined period of time.

8. The shredder of claim 7, wherein the indicator provides visual indication.

9. The shredder of claim 7, wherein the indicator provides audible indication.

10. The shredder of claim 1, wherein the receptacle comprises a bottom and at least one wall extending from the bottom to define an open top to receive the shredded material.

11. The shredder of claim 1 further comprises a timer set to the predetermined period of time, the time being used to determines if the beam has been interrupted for at least the predetermined period of time.

* * * * *

US006978954C1

(12) INTER PARTES REEXAMINATION CERTIFICATE (1131st)

United States Patent
Kroger et al.

(10) Number: US 6,978,954 C1
(45) Certificate Issued: Jun. 22, 2015

(54) DETECTOR FOR A SHREDDER

(75) Inventors: Bruce R. Kroger, West Chicago, IL (US); Dmitry N. Romanovich, Glen Ellyn, IL (US); Vadim N. Romanovich, Glen Ellyn, IL (US)

(73) Assignee: FELLOWES, INC., Itasca, IL (US)

Reexamination Request:
No. 95/001,722, Sep. 2, 2011

Reexamination Certificate for:

| | |
|---|---|
| Patent No.: | **6,978,954** |
| Issued: | **Dec. 27, 2005** |
| Appl. No.: | **09/940,726** |
| Filed: | **Aug. 28, 2001** |

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |
| ***B02C 18/00*** | (2006.01) |

(52) U.S. Cl.
CPC ..... *B02C 18/0007* (2013.01); *B02C 2018/0038* (2013.01); *B02C 2018/0023* (2013.01)

(58) Field of Classification Search
None
See application file for complete search history.

(56) References Cited

To view the complete listing of prior art documents cited during the proceeding for Reexamination Control Number 95/001,722, please refer to the USPTO's public Patent Application Information Retrieval (PAIR) system under the Display References tab.

*Primary Examiner* — Danton DeMille

(57) ABSTRACT

A shredder for shredding material is provided that includes a housing, having a cutting device to shred material. A receptacle is also included and is positioned to receive the shredded material. A detecting device is positioned between the cutting device and the receptacle and emits and detects a beam so that when shredded material occupies a first position within the receptacle the beam is interrupted. Advantageously, the detecting device may be used as a bin full detection device to provide indication that a bin is filled or substantially filled with shredded material.

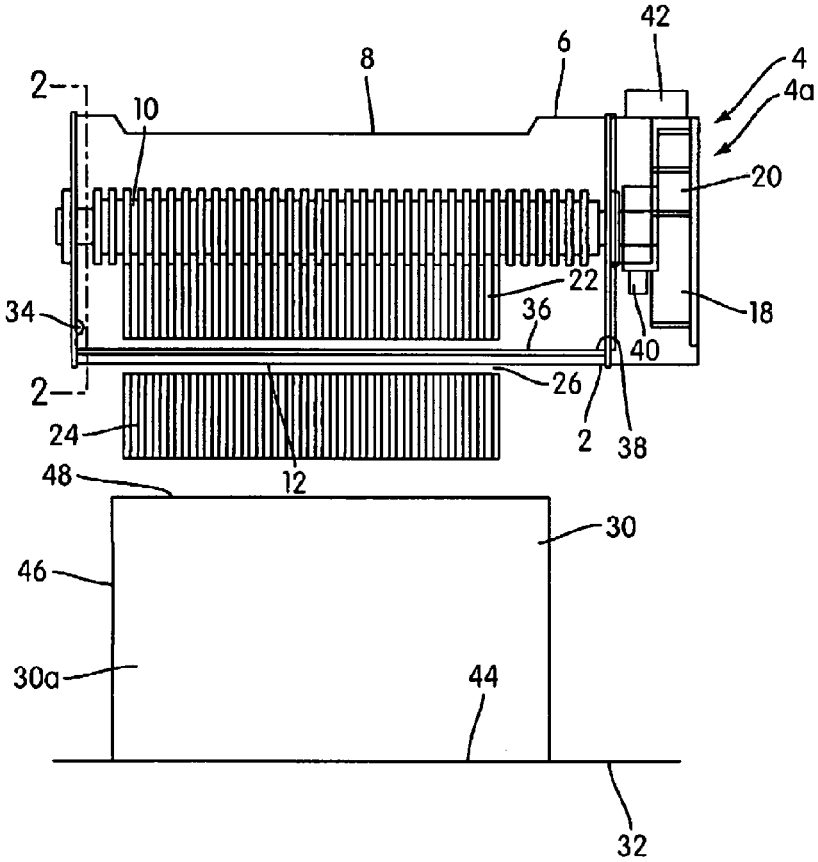

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-11 are cancelled.

* * * * *